US009870702B2

(12) United States Patent
Shim et al.

(10) Patent No.: US 9,870,702 B2
(45) Date of Patent: Jan. 16, 2018

(54) METHOD FOR FORWARDING REMOTE CONTROL SIGNAL AND SIGNAL FORWARDING NODE USING THE SAME

(71) Applicant: LG ELECTRONICS INC., Seoul (KR)

(72) Inventors: Hongjo Shim, Seoul (KR); Gukchan Lim, Seoul (KR); Seonghyok Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/059,065

(22) Filed: Mar. 2, 2016

(65) Prior Publication Data

US 2017/0018175 A1 Jan. 19, 2017

(30) Foreign Application Priority Data

Jul. 13, 2015 (KR) ..... 10-2015-0099183

(51) Int. Cl.
*G08C 23/04* (2006.01)

(52) U.S. Cl.
CPC ..... *G08C 23/04* (2013.01); *G08C 2201/40* (2013.01)

(58) Field of Classification Search
None
See application file for complete search history.

(56) References Cited

U.S. PATENT DOCUMENTS 4,809,359 A 2/1989 Dockery
5,307,193 A 4/1994 VanZeeland et al.
5,983,068 A * 11/1999 Tomich ..... H04B 10/27 348/E7.094
6,314,406 B1 * 11/2001 O'Hagan ..... G06K 7/0004 705/14.23
6,437,836 B1 * 8/2002 Huang ..... G06F 1/1626 340/12.54
6,812,881 B1 11/2004 Mullaly et al.
6,972,680 B2 * 12/2005 Yui ..... G08C 17/02 340/286.02
7,373,431 B2 * 5/2008 Kondo ..... H04N 5/44 348/E5.002
8,983,300 B1 * 3/2015 Metrani ..... G08C 23/04 398/106
9,087,448 B2 * 7/2015 De Buysscher ..... G08C 19/28
(Continued)

OTHER PUBLICATIONS

European Patent Application No. 16171294.8, Search Report dated Nov. 21, 2016, 7 pages.

*Primary Examiner* — K. Wong
(74) *Attorney, Agent, or Firm* — Lee, Hong, Degerman, Kang & Waimey

(57) ABSTRACT

A method for forwarding a remote control signal and a signal forwarding node using the same are disclosed. Herein, the signal forwarding node includes a laser light receiver configured to detect laser light, an Infra Red (IR) light receiver configured to receive a remote control signal, a wireless communication module configured to transmit and receive data to and from an external signal forwarding node, and a controller configured to control the wireless communication module, when laser light is detected through the laser light receiver, and when the remote control signal is received, so as to forward control information included in the received remote control signal to the external signal forwarding node.

16 Claims, 11 Drawing Sheets

(56) References Cited

U.S. PATENT DOCUMENTS

| | | | | |
|---|---|---|---|---|
| 9,300,398 | B2 * | 3/2016 | Chaffee | H04B 10/11 |
| 2003/0178554 | A1 | 9/2003 | Zak | |
| 2008/0231464 | A1 * | 9/2008 | Lewis | H05B 37/0272 340/5.74 |

* cited by examiner

METHOD FOR FORWARDING REMOTE CONTROL SIGNAL AND SIGNAL FORWARDING NODE USING THE SAME

CROSS-REFERENCE TO RELATED APPLICATIONS

Pursuant to 35 U.S.C. §119(a), this application claims the benefit of earlier filing date and right of priority to Korean Patent Application No. 10-2015-0099183, filed on Jul. 13, 2015, the contents of which are hereby incorporated by reference herein in their entirety.

BACKGROUND OF THE INVENTION

Field of the Invention

The present invention relates to a signal forwarding node, which receives and forwards a signal so that the signal can reach a location where a remote control signal cannot be easily forwards, and a method for controlling the same.

Discussion of the Related Art

Electrical appliances (or devices), such as a TV, an air conditioner, a fan, and so on, may receive a user command through a remote controller. For example, in case of a remote controller controlling a TV, diverse keys, such as a power key, channel switching keys, volume control keys, number keys, an external input key, and so on, may be assigned to the remote controller.

Generally, a remote controller transmits a user control command to an electrical appliance by using an Infra Red (IR) signal. In case of the IR signal, due to its linearity (or straightness), since the control command is inputted while the remote controller is pointing at the electrical appliance, which is intended to be controlled, it is advantageous in that its usage is intuitive. However, such IR signal is disadvantageous in that, in case the path of the signal is blocked by a wall or door existing in-between rooms, the signal cannot be delivered to the intended electrical appliance.

Conversely, in case of a remote controller that is based on wireless communication, indoor electrical appliances may also be controlled outdoors via remote control (or long-ranged control) by using a frequency that can pass through walls or doors. However, in case of performing such remote control (or long-ranged control) based on wireless communication, it may be disadvantageous in that the control cannot be intuitively performed by the user. This is because such control does not require a control signal to be delivered by directly pointing at the electrical appliance, which is intended to be controlled.

Therefore, a control method that can supplement the disadvantages of both of the above-described methods is being required to be researched and developed.

SUMMARY OF THE INVENTION

Accordingly, the present invention is directed to a method for forwarding a remote control signal and a signal forwarding node using the same that substantially obviate one or more problems due to limitations and disadvantages of the related art.

Another technical object is to provide a method for forwarding a remote control signal and a signal forwarding node using the same that can properly forward (or deliver) a signal to a shadow area of an IR remote control signal.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, in an aspect of the present invention, a signal forwarding node includes a laser light receiver configured to detect laser light, an Infra Red (IR) light receiver configured to receive a remote control signal, a wireless communication module configured to transmit and receive data to and from an external signal forwarding node, and a controller configured to control the wireless communication module, when laser light is detected through the laser light receiver, and when the remote control signal is received, so as to forward control information included in the received remote control signal to the external signal forwarding node.

In another aspect of the present invention, a method for controlling signal forwarding includes the steps of detecting laser light through a laser light receiver, receiving a remote control signal, and, when laser light is detected through the laser light receiver, and when the remote control signal is received, controlling a wireless communication module, so as to forward control information included in the received remote control signal to an external signal forwarding node.

According to the present invention, there is a good point that it is available to control the electrical appliances which are in another room using the intuitive controlling method.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1A:
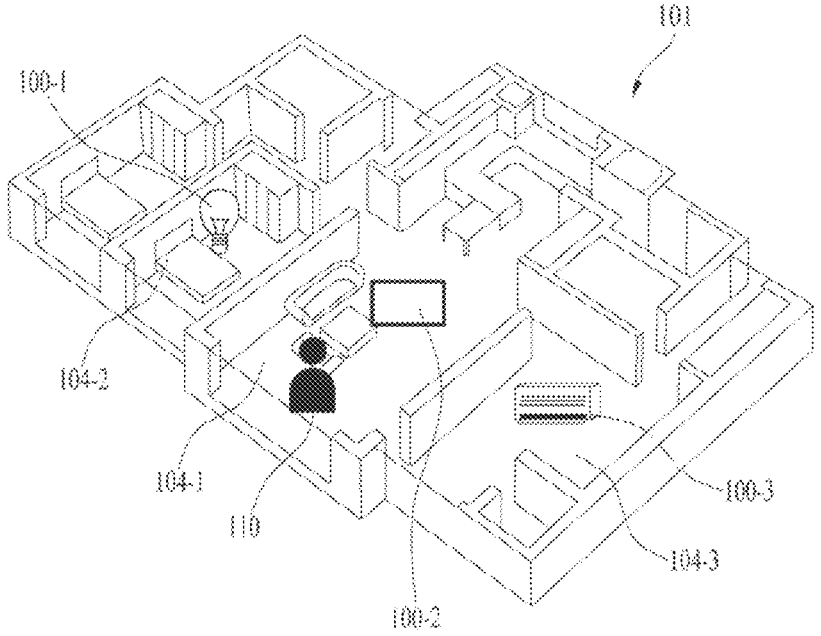
FIGS. 1A and 1B illustrate a shadow area to which a remote control signal (hereinafter referred to as remote signal) cannot be forwarded (or delivered) in case of using an IR signal according to an exemplary embodiment of the present invention.

Reference will now be made in detail to the preferred embodiments of the present invention, examples of which are illustrated in the accompanying drawings. Wherever possible, the same reference numbers will be used throughout the drawings to refer to the same or like parts, and repeated description will be omitted for simplicity. The suffixes "module" and "unit" that are mentioned in the elements used to describe the present invention are merely used for the purpose of simplifying the description of the present invention. Therefore, the suffixes "module" and "unit" may also be alternately used for the reference of a specific element of the present invention. Each of the suffixes will not be signified or used to differential one from the other. Additionally, in describing exemplary embodiments, which are disclosed in this specification, when it is determined that detailed description of related technologies, which have already been disclosed, may cause ambiguity in the concept of the exemplary embodiments disclosed in this specification, the detailed description of the same will be omitted for simplicity. Moreover, the accompanying drawings are merely provided to facilitate the understanding the exemplary embodiments disclosed in this specification. And, therefore, the technical scope and spirit disclosed in this specification will not be limited only to the accompanying drawings. And, therefore, it should be understood that the accompanying drawings include all variations, equivalents and replacements that are included in the technical scope and spirit of the present invention.

Terms including ordinal numbers, such as "first", "second", and so on, may be used for describing diverse elements. However, such elements will not be limited only to such terms. Herein, the corresponding terms will only be used to differentiate one element from another element.

When an element is said (or described) to be "connected to" or "in connection with" another element, the corresponding element may be directly connected to or may be in direct connection with the other element. However, it should be understood that yet another element may exist in-between. Conversely, when an element is said (or described) to be "directly connected to" or "in direct connection with" another element, although the corresponding element may be directly connected to or may be in direct connection with the other element, it should also be understood that no other element exists between the two elements.

Additionally, unless clearly mentioned otherwise within the context, singular form expressions shall include the respective plural form expressions.

In this application, the terms "include(s)" or "have (or has)" are merely used to indicate the presence of a characteristic, number, step, operation, element, assembly part, or a combination of at least two or more of the above, which are mentioned in the description of the present invention. And, therefore, it should be understood that the presence or possibility of additionally including one or more of other characteristics, numbers, steps, operations, elements, assembly parts, or combinations of the above will not be excluded in advance.

Electrical appliances (or devices), such as a TV, an air conditioner, a fan, and so on, may receive a user command through a remote controller. For example, in case of a remote controller controlling a TV, diverse keys, such as a power key, channel switching keys, volume control keys, number keys, an external input key, and so on, may be assigned to the remote controller.

Generally, a remote controller transmits a user control command to an electrical appliance by using an Infra Red (IR) signal. In case of the IR signal, due to its linearity (or straightness), since the control command is inputted while the remote controller is pointing at the electrical appliance, which is intended to be controlled, it is advantageous in that its usage is intuitive. However, such IR signal is disadvantageous in that, in case the path of the signal is blocked by a wall or door existing in-between rooms, the signal cannot be delivered to the intended electrical appliance.

Conversely, in case of a remote controller that is based on wireless communication, indoor electrical appliances may also be controlled outdoors via remote control (or long-ranged control) by using a frequency that can pass through walls or doors.

However, in case of performing such remote control (or long-ranged control) based on wireless communication, it may be disadvantageous in that the control cannot be intuitively performed by the user. This is because such control does not require a control signal to be delivered by directly pointing at the electrical appliance, which is intended to be controlled.

Furthermore, a large number of electrical appliances that are already being used transmit and receive remote control signals by using IR signals. Accordingly, a control method that can supplement the disadvantages of both of the above-described methods, while using IR signals, is being required to be researched and developed.

The exemplary embodiment of the present invention proposes to use an intuitive control method by using the IR signal while forwarding IR signals to shadow areas where forwarding of IR signals is impossible by performing signal exchange between signal forwarding nodes.

Figure 1B:
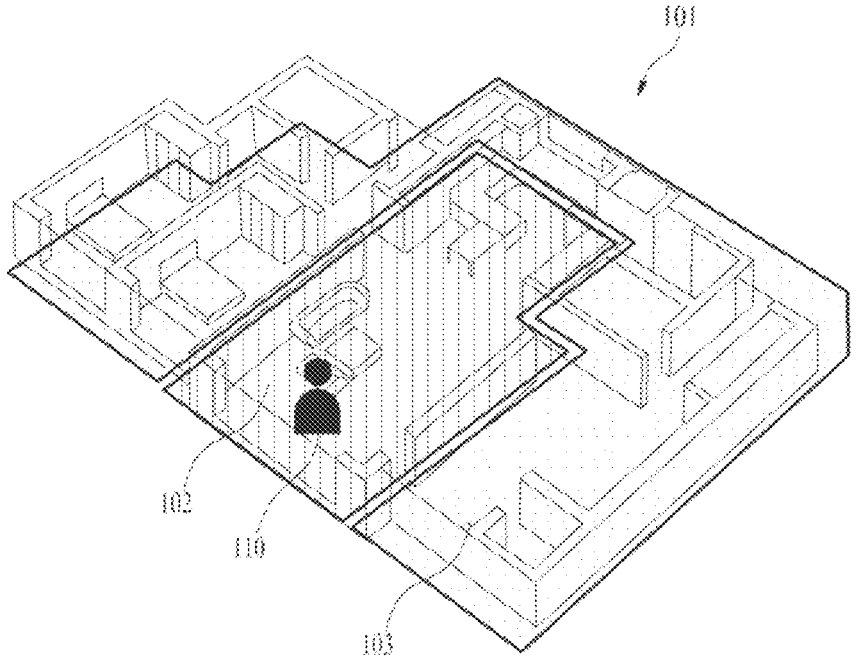

FIGS. 1A and 1B illustrate a shadow area to which a remote control signal (hereinafter referred to as remote signal) cannot be forwarded (or delivered) in case of using an IR signal according to an exemplary embodiment of the present invention.

FIG. 1A and FIG. 1B describe the control of electrical appliances (or devices) 100-1 to 100-3 based upon design schematics 101 of a general household.

Referring to the design schematics 101 of FIG. 1A, it will be assumed that User 110 and TV 100-2 are positioned in Living Room 104-1, that Lamp 100-1 is positioned in First Room (or Room 1) 104-2, and that Air Conditioner 100-3 is positioned in Second Room (or Room 2) 104-3.

Although the user 110 may control the TV 100-2 by manipulating an IR remote controller, the user 110 cannot control the Lamp 100-1 or the Air Conditioner 100-3 located in Room 1 and Room 2 104-2 and 104-3. This is because the IR remote controller cannot forward an accurate control signal, since the strength (or intensity) of the control signal abruptly decreases when passing through a wall or a door.

The design schematics 101 of FIG. 1B illustrate a reachable area 102 and an unreachable area (or non-reachable area) 103 of the control signal by the manipulation of the IR remote controller, which is performed by the User 110 being positioned in the Living Room 104-1.

In the exemplary embodiment of the present invention that will hereinafter be described in detail, an area to which the signal cannot be forwarded due to the structure of a building or due to another object or an area to which a signal cannot reach due to its distant range will be broadly referred to as a shadow area 103. And, conversely, an area to which the signal can be reached will be referred to as a reachable area 102.

The exemplary embodiment of the present invention proposes a method for controlling an electrical appliance that is positioned in the shadow area 103 by using an IR signal.

In order to do so, the exemplary embodiment of the present invention proposes to provide a signal forwarding node in each of the reachable area 102 and the shadow area 103, and proposes to forward an IR signal to a second signal forwarding node existing in the shadow area 103, when a first signal forwarding node existing in the reachable area 102 receives the IR signal, and proposes to allow the second signal forwarding node to reproduce (or regenerate) the corresponding IR signal so as to forward the reproduced (or regenerated) IR signal to a final electrical appliance. This concept will be described in more detail with reference to FIG. 2.

Figure 2:
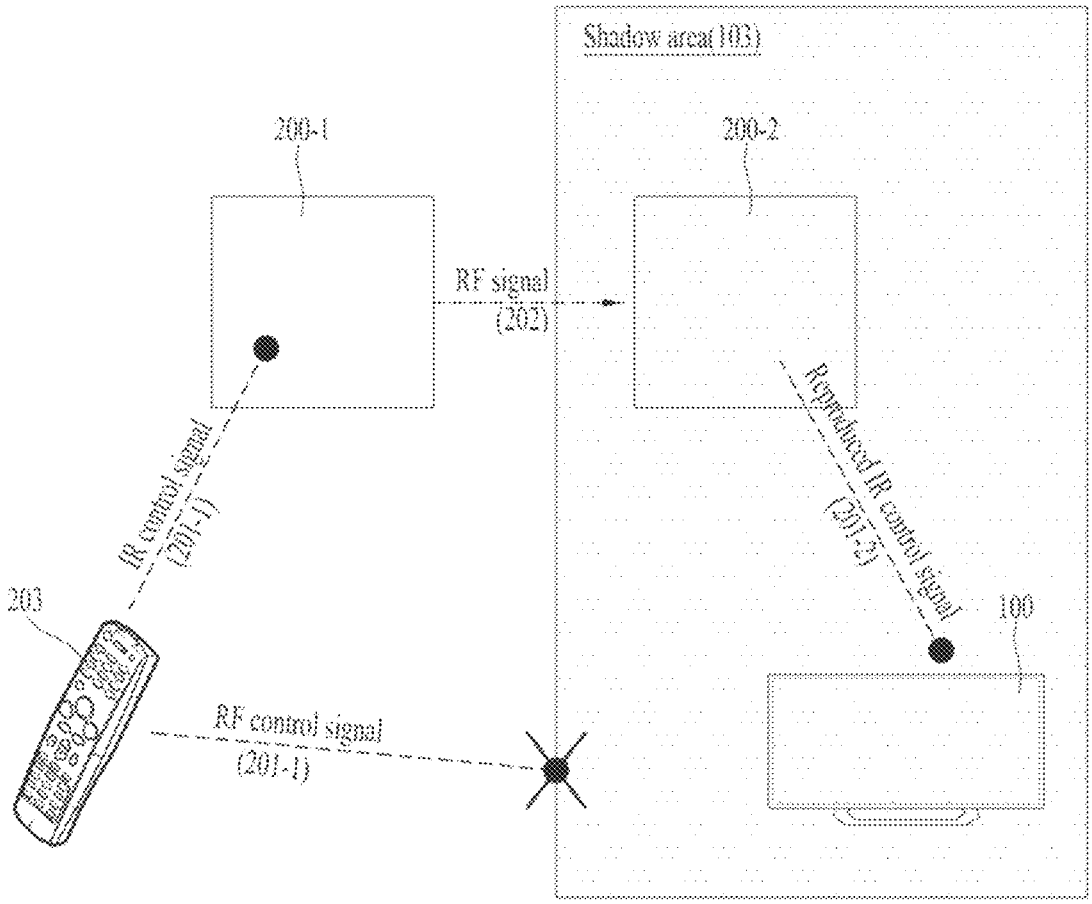
FIG. 2 illustrates an IR control signal, which is transmitted from a remote controller, being forwarded to a shadow area through a signal forwarding node according to an exemplary embodiment of the present invention.

FIG. 2 illustrates an IR control signal, which is transmitted from a remote controller 203, being forwarded to a shadow area through a signal forwarding node 200-1 and 200-2 according to an exemplary embodiment of the present invention.

As shown in FIG. 2, it will be assumed that the user has manipulated the remote controller 203, and that, accordingly, the IR control signal 201-1 has been transmitted from the remote controller 203. This IR control signal 201-1 corresponds to a signal that is designated to control the TV 100, which is positioned in the shadow area 103.

The IR control signal 201-1 will be able to directly reach the TV 100, which is positioned in the shadow area 103.

The first signal forwarding node 200-1 according to the exemplary embodiment of the present invention receives the IR control signal 201-1 and, then, converts the received IR control signal 201-1 to a Radio Frequency (RF) signal 202, which is then forwarded (or delivered) to the second signal forwarding node 200-2.

At this point, even if the second signal forwarding node 200-2 is positioned in the shadow area 103, the second signal forwarding node 200-2 may receive the RF signal 202. This is because the transmissivity (penetration ratio) of the RF signal is better than that of the IR signal. More specifically, the IR control signal 201-1 is temporarily converted to the RF signal 202 in order to be transmitted to the shadow area 103.

When the second signal forwarding node 200-2, which exists in the shadow area 103, receives the RF signal 202, the second signal forwarding node 200-2 reproduces (or regenerates) the received RF signal 202 back to an IR signal (reproduced (or regenerated) IR control signal 201-2) and, then, forwards the reproduced (or regenerated) IR control signal 201-2 to the TV 100.

At this point, even if the second signal forwarding node 200-2 and the TV 100 exist in the same shadow area, if there is not obstacle between the second signal forwarding node 200-2 and the TV 100, or if the distance between the second signal forwarding node 200-2 and the TV 100 is short, the reproduced (or regenerated) IR control signal 201-2 shall be capable of being forwarded.

That is to say, in light of the second signal forwarding node 200-2, it may be considered that the TV 100 is positioned in the reachable area 102.

As a more specific example, a situation wherein the User 110 manipulates remote controller 203 in the Living Room 104-1 will be assumed. The first signal forwarding node 200-1 will also be positioned in the Living Room 104-1. When the User 110 manipulates a button of the remote controller 203, while the User 110 is in a state of indicating (or pointing at) the first signal forwarding node 200-1 by using the remote controller 203, the IR control signal 201-1 shall be transmitted to the first signal forwarding node 200-1.

After receiving the IR control signal 201-1, the first signal forwarding node 200-1 converts the received IR control signal 201-1 to a RF signal 202 and, then, forwards the converted RF signal 202 to the second signal forwarding node 200-2, which exists in the first room (or Room 1) 104-2.

The second signal forwarding node 200-2 may reproduce (or regenerate) the received RF signal back to an IR signal, and may then forward the reproduced (or regenerated) IR signal to the TV 100, which is positioned in the first room (or Room 1) 104-2.

According to such control method, even in an IR signal having degraded transmissivity (penetration ratio) is used, the control signal may be transmitted without any restrictions caused by obstacles. Hereinafter, a block view of the remote controller and the signal forwarding node will be described in detail with reference to FIG. 3 and FIG. 4.

Figure 3:
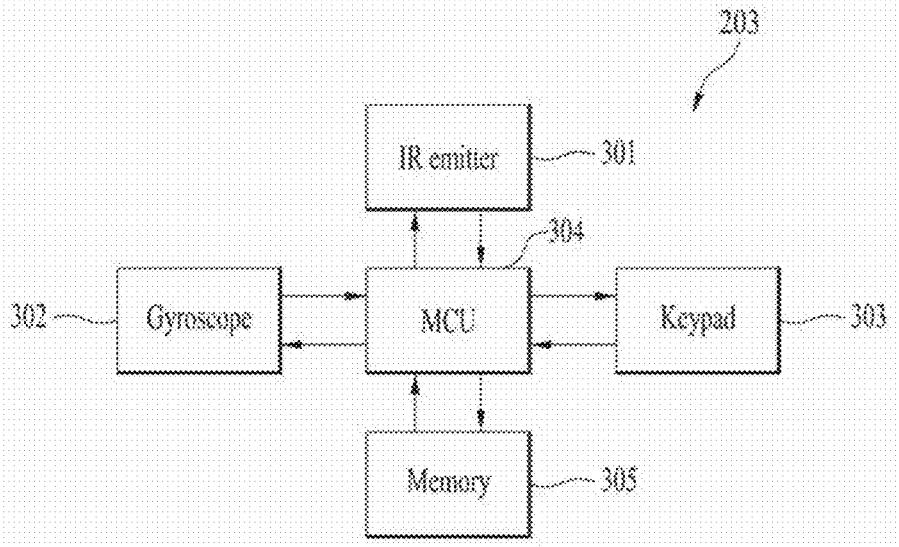
FIG. 3 illustrates an exemplary structure of the remote controller according to an exemplary embodiment of the present invention.

FIG. 3 illustrates an exemplary structure of the remote controller 203 according to an exemplary embodiment of the present invention.

The remote controller 203 according to an exemplary embodiment of the present invention may be configured of an IR emitter 301, a Gyroscope 302, a KeyPad 303, a Micro Controller Unit (MCU) 304, and/or a Memory 305.

The IR emitter 301 may transmit a signal of the remote controller 203 via Infra Red light rays (or waves). A unique code for each key may be defined for each external electrical appliance, which the remote controller 203 seeks to control.

The exemplary embodiment of the present invention proposes the unique IR code for each external electrical appliance to be updated or downloaded by the signal forwarding node itself, which will hereinafter be described in more detail.

The Gyroscope 302 generates information on the position and movements of the remote controller 203. The Gyroscope 302 may forward (or deliver) the information on the position and movements of the remote controller 203 to the MCU 304.

Button input within the remote controller 203 may be realized through the KeyPad 303.

The Micro Controller Unit (MCU) 304 may control an interface with the IR emitter 301. The MCU 304 may process the information on the position and movements of the remote controller 203, which is received from the Gyroscope 302, and may then generate a control signal. The MCU 304 may process the input value of the keypad 303 and may then forward (or deliver) the processed value to the external electrical appliance (or device).

The Memory 305 may be used as a storage space that is required for IR key codes related to at least one external electrical appliance and for executing programs in order to operate the remote controller 203.

Subsequently, a block view of the signal forwarding nodes 200-1 and 200-2 will hereinafter be described in detail with reference to FIG. 4.

Figure 4:
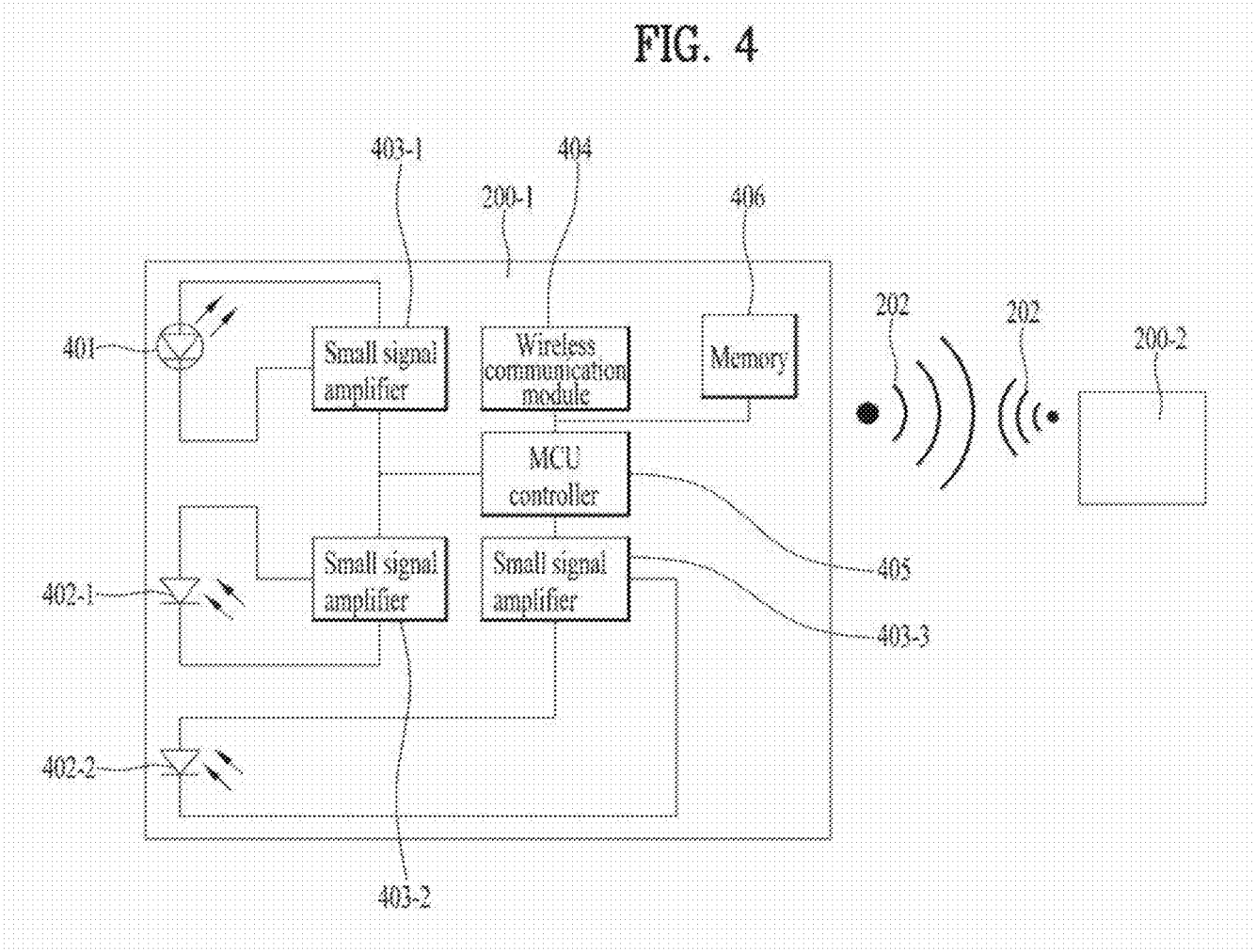
FIG. 4 illustrates a block view of a signal forwarding node according to an exemplary embodiment of the present invention.

FIG. 4 illustrates a block view of a signal forwarding node according to an exemplary embodiment of the present invention.

The signal forwarding node may include at least one of an IR emitter 401, an IR light receiver 402-1, a laser light receiver 402-2, first to third small signal amplifiers 403-1 to 403-3, a Micro Controller Unit (MCU) (or controller) 405, a memory 406, and a wireless communication module 404.

The IR emitter 401 may transmit a signal of the remote controller 203, which is reproduced (or regenerated) by the signal forwarding node, via Infra Red light rays (or waves). The IR emitter 401shall perform the same functions as the IR emitter 301 of the remote controller 203, which is described above with reference to FIG. 3.

The exemplary embodiment of the present invention proposes to further include a dispersion lens so as to allow the reproduced IR control signal, which is transmitted from the IR emitter 401, to be dispersed in diverse directions.

The dispersion lens refers to a lens that can disperse (or scatter) light being emitted from a light source in multiple directions, such as in a fly-eye lens structure.

In addition to the above-described dispersion lens, the present invention may also be designed to disperse (or scatter) the IR control signal, which is reproduced (or regenerated) in the IR emitter 401, into multiple directions by using a light diffusion sheet. The structure of the light diffusion sheet will hereinafter be described in detail.

The IR light receiver 402-1 may receive the IR control signal, which is transmitted from the remote controller 203, and, then, the IR light receiver 402-1 may forward the received IR control signal to the MCU 405 through the second small signal amplifier 403-2.

The laser light receiver 402-2 may detect a laser signal, which is transmitted by the remote controller 203. The exemplary embodiment of the present invention proposes to use a laser pointer, which is equipped in the remote controller 203, when any one signal forwarding node is to be selected and controlled among the multiple signal forwarding nodes.

In order to allow the laser pointer to detect laser light that is being transmitted, the signal forwarding node may be equipped with a laser light receiver 402-2. The exemplary embodiment of the present invention will hereinafter be described later on in detail.

The first to third small signal amplifiers 403-1 to 403-3 may each perform a function of amplifying the signals that are respectively being transmitted and received to and from the IR receiver 401, the IR light receiver 402-1, and the laser light receiver 402-2 and, then, forwarding the amplified signals.

The Micro Controller Unit (MCU) (or controller) 405 may perform a function of performing an overall control of the signal forwarding node.

The wireless communication module 404 corresponds to a module that is configured to perform data transmission and reception with at least one external device (including other signal forwarding nodes). Herein, the wireless communication module 404 may use short-range communication by using at least one of the following technologies: Bluetooth™, Radio Frequency Identification (RFID), Infrared Data Association (IrDA), Ultra Wideband (UWB), ZigBee, Near Field Communication (NFC), Wireless-Fidelity (Wi-Fi), Wi-Fi Direct, and Wireless Universal Serial Bus (Wireless USB). Additionally, the wireless communication module 404 may use a wireless internet technology or mobile communication technology, such as Wireless LAN (WLAN), Wireless-Fidelity (Wi-Fi), Wireless Fidelity (Wi-Fi) Direct, Digital Living Network Alliance (DLNA), Wireless Broadband (WiBro), World Interoperability for Microwave Access (WiMAX), High Speed Downlink Packet Access (HSDPA), High Speed Uplink Packet Access (HSUPA), Long Term Evolution (LTE), Long Term Evolution-Advanced (LTE-A), and so on.

By using diverse wireless communication technologies, the wireless communication module 404 may forward (or deliver) the converted IR control signal to other signal forwarding nodes.

The exemplary embodiment of the present invention proposes that the IR codes required by each electrical appliance (or device) are automatically received by using the wireless communication module 404.

For example, the exemplary embodiment of the present invention proposes to establish a DB in a specific web site among users and, then, to allow the users to automatically download the most recently updated IR code in accordance with the selection made by the user of the selection made by the MCU 405.

The memory 406 may store the IR code information.

Hereinafter, exemplary embodiments being related to the control method that can be realized in the remote controller and the signal forwarding node each having the above-described structures will be described in detail with reference to the accompanying drawings. It will be apparent to anyone skilled in the art that the present invention can be varied and modified to another specific form without departing from the technical, spiritual, and essential scope of the present invention. Hereinafter, the detailed exemplary embodiment of the flow chart shown in FIG. 5 will be described in detail.

Figure 5:
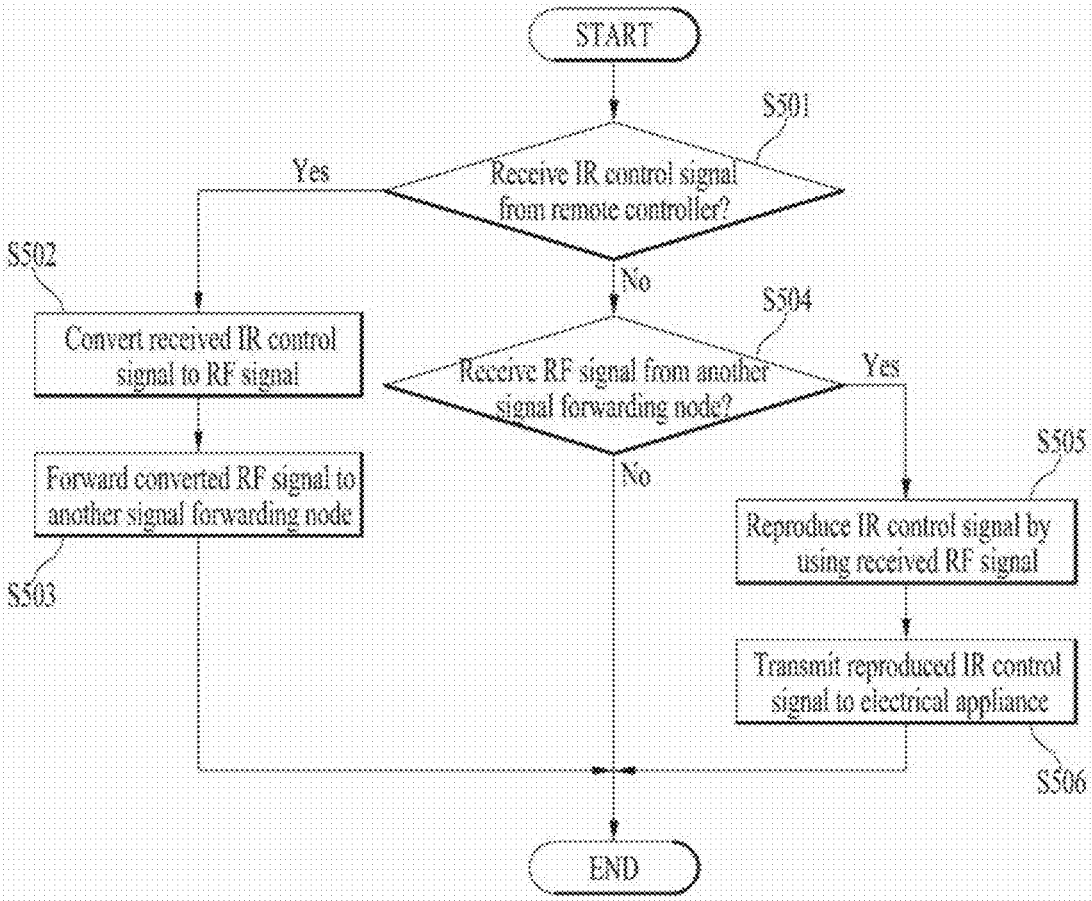
FIG. 5 illustrates a control flow chart of a signal forwarding node according to an exemplary embodiment of the present invention.

FIG. 5 illustrates a control flow chart of a signal forwarding node 200-1 and 200-2 according to an exemplary embodiment of the present invention.

In this exemplary embodiment of the present invention, the first signal forwarding node 200-1 and the second signal forwarding node 200-2 operate in a state of being paired to one another (i.e., a paired state).

Herein, the paired state may refer to a state of having the two signal forwarding nodes 200-1 and 200-2 establish a session, so as to allow the two signal forwarding nodes 200-1 and 200-2 to transmit and receive data. Hereinafter, although the description will be provided based upon an assumption of establishing one-to-one (1:1) pairing, it will be apparent that two or more signal forwarding nodes may be paired to a single signal forwarding node.

In this exemplary embodiment of the present invention, a function of a transmitting (or delivering) node (S501->S502->S503 path), wherein the IR control signal is received from the remote controller, and wherein the IR signal is converted to a RF signal in order to forward (or deliver) the received IR signal to another signal forwarding node, may exist.

And, conversely, a function of a receiving node (S504->S505->S506 path), wherein the RF signal is received from another signal forwarding node, and wherein the received RF signal is reproduced (or regenerated) to an IR signal, may exist.

Hereinafter, each of the function will be described in detail.

The function of the transmitting node may start by receiving an IR control signal in step S501. After receiving the IR control signal, the MCU 405 may convert the received IR control signal to a RF signal (step S502). The signal that is converted to the RF signal may include information on the IR code, which is included in the IR control signal.

In step S503, the MCU 405 may be capable of forwarding the converted RF signal to another signal forwarding node. At this point, the other signal forwarding node may correspond to the above-described paired signal forwarding node.

The function of the receiving node may start by receiving the RF signal in step S504.

After receiving the RF signal, the MCU 405 may reproduce (or regenerate) the received RF signal to an IR control signal (step S505). In step S506, the reproduced (or regenerated) IR control shall be transmitted to a corresponding electrical appliance (or device). At this point, the transmission of the regenerated IR control signal shall be performed by transmitting an IR code respective to the corresponding electrical appliance.

That is to say, although the IR code may be transmitted to all of the electrical appliances, since the IR code corresponds only to its respective electrical appliance, the transmission of the IR code is only effective to the corresponding electrical appliance.

As shown in the flow chart of FIG. 5, the paired signal forwarding node may perform the function of the transmitting node and may also perform the function of the receiving node at the same time.

That is to say, when he operates the Fan that is in the room while the user is in the Living Room, the signal forwarding node that is in the Living Room shall perform the function of the forwarding (or transmitting) node, and the signal forwarding node that is positioned in the room shall perform the function of the receiving node.

When the user moves from the Living Room to the room and then the user operates the TV that is in the Living Room while the user is in the room, the functions of each node may be switched.

Meanwhile, multiple paired signal forwarding nodes according to an exemplary embodiment of the present invention may be used. The exemplary embodiment will hereinafter be described in detail with reference to FIGS. 6A and 6B.

Figure 6A:
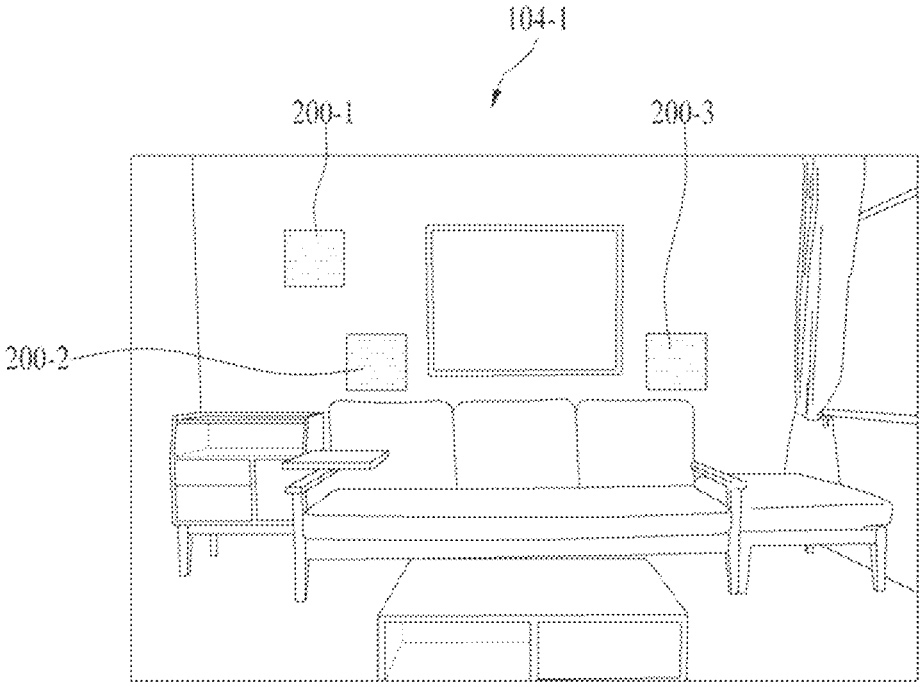
FIGS. 6A and 6B illustrate an exemplary usage of multiple signal forwarding nodes being formed in pairs according to an exemplary embodiment of the present invention.
Figure 6B:
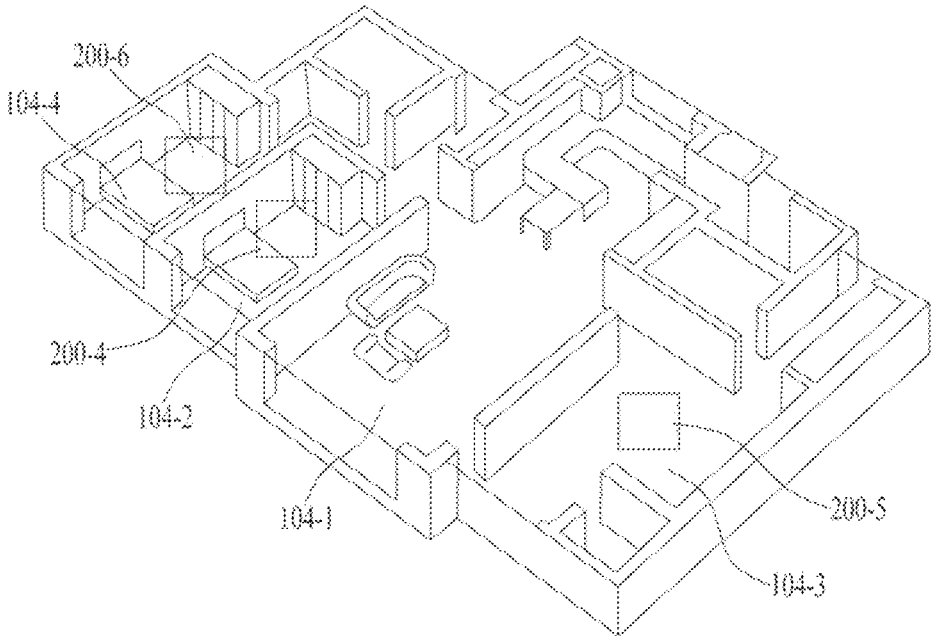

FIGS. 6A and 6B illustrate an exemplary usage of multiple signal forwarding nodes being formed in pairs according to an exemplary embodiment of the present invention.

Referring to FIG. 6A, a front view of the Living Room 104-1 is illustrated, and the first to third signal forwarding nodes 200-1 to 200-3 are hung (or installed) on a wall of the Living Room 104-1.

And, the first to third signal forwarding nodes 200-1 to 200-3 are formed as photo frames or picture frames in order to create a more decorative (or more beautiful or aesthetic) interior.

Referring to FIG. 6B, herein, it will be assumed that the first to third signal forwarding nodes 200-1 to 200-3 are respectively paired with fourth to sixth signal forwarding nodes 200-4 to 200-6. And, each of the fourth to sixth signal forwarding nodes 200-4 to 200-6 may be positioned in a second room (or Room 2) 104-2 to a fourth room (or Room 4) 104-4.

When the user intends to control an electrical appliance that is positioned in the second room (or Room 2) 104-2, the user shall be capable of performing operation by pointing the remote controller 203 to the first signal forwarding node 200-1, which is paired with the fourth signal forwarding node 200-4 being positioned in the second room (Room 2) 104-2.

That is to say, since the signal forwarding nodes that are positioned in the Living Room 104-1 are respectively paired with the signal forwarding nodes that are positioned in each room, the user may be capable of forwarding the IR control signal to a desired (or wanted) room.

Meanwhile, as shown in the front view of the Living Room 104-1 of FIG. 6A, since the first signal forwarding node 200-1 and the second signal forwarding node 200-2 are positioned to be too close to one another, it may be difficult to select any one signal forwarding node.

Accordingly, the exemplary embodiment of the present invention proposes a laser pointer to be further included in the remote controller 203, and the exemplary embodiment of the present invention also proposes that the IR control signal is forwarded only to the signal forwarding node, which is indicated (or pointed) by the corresponding laser pointer. This exemplary embodiment will hereinafter be described in detail with reference to FIG. 7A-7B.

Figure 7B:
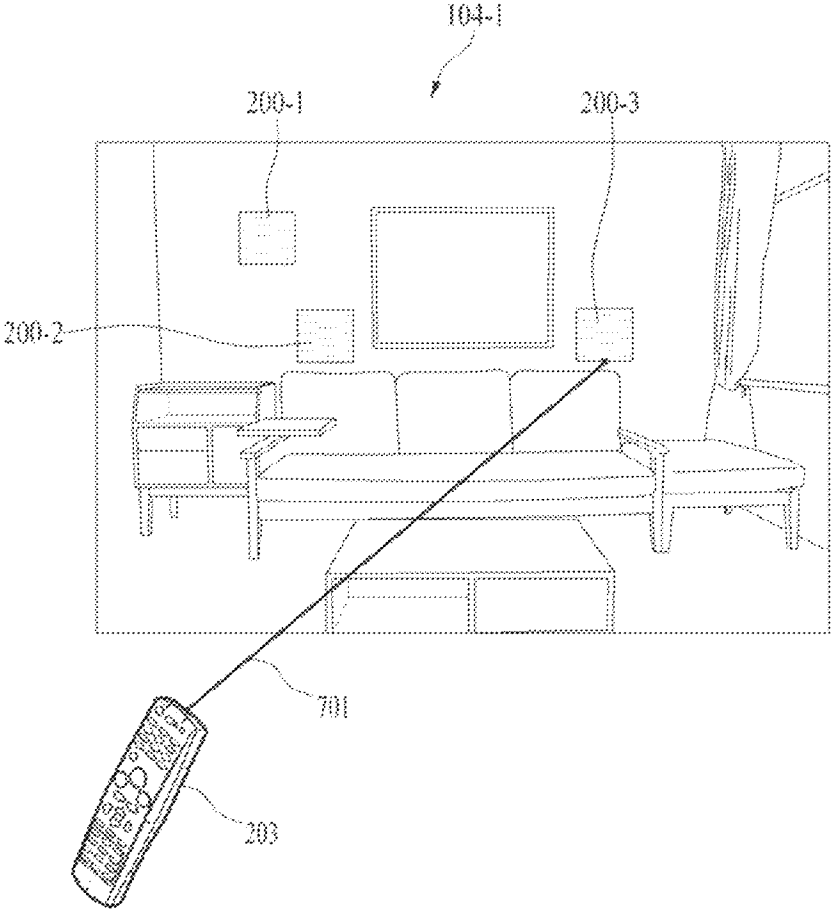
FIGS. 7A and 7B illustrate a control method for only controlling a signal forwarding node that is indicated by a laser pointer according to an exemplary embodiment of the present invention.
Figure 7A:
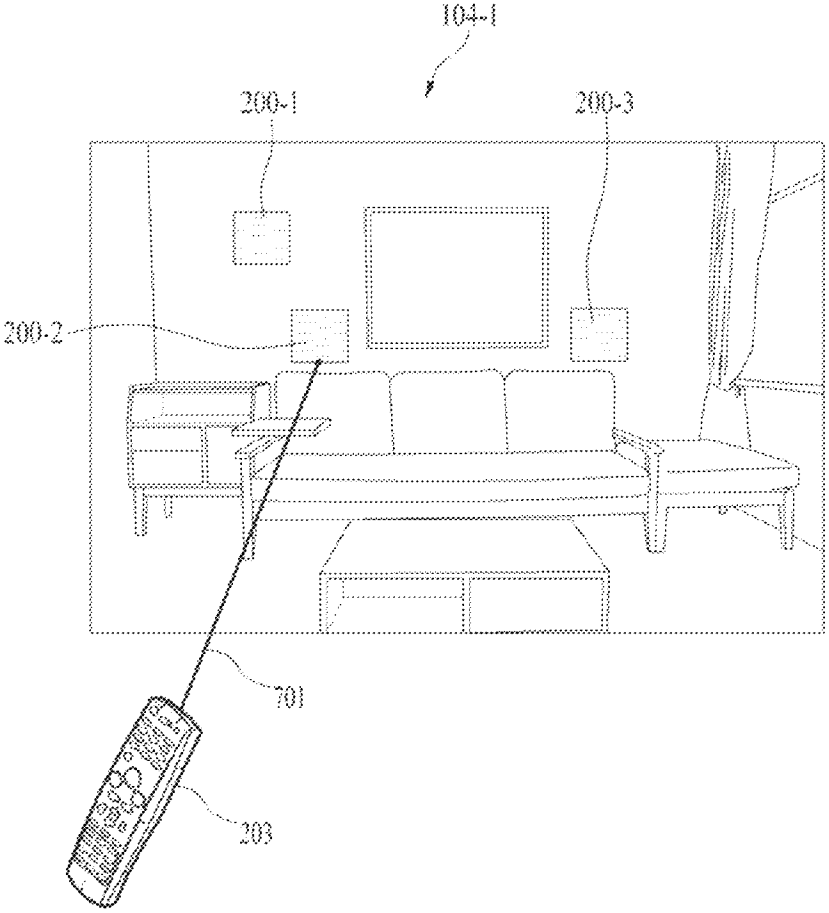

FIG. 7A-7B illustrate a control method for only controlling a signal forwarding node that is indicated by a laser pointer according to an exemplary embodiment of the present invention.

Referring to FIG. 7A and 7B, as shown in FIG. 6, first to third signal forwarding nodes 200-1 to 200-3 are provided (or installed) in the Living Room 104-1.

The user is pointing at the second signal forwarding node 200-2 by using a laser 701, which is emitted from a laser pointer of the remote controller 203. In this state, when the user manipulates a button on the remote controller 203, only the second signal forwarding node 200-2 may be capable of converting the corresponding IR control signal to a RF signal.

That is to say, even if the IR control signal is received from the remote controller 203, the first signal forwarding node 200-1 and the third signal forwarding node 200-3 may disregard (or ignore) such reception.

In order to do so, in each of the signal forwarding nodes, if laser light is not detected by the laser light receiver 402-2, even if the IR control signal is not received from the IR light receiver 402-1, or even if the IR control signal is received, the received IR control signal will not be forwarded to another signal forwarding node that is paired to the corresponding signal forwarding node.

This is because the user intends to forward (or deliver) the IR control signal only to the signal forwarding node, which the user has pointed (or indicated) by using the laser pointer.

Meanwhile, since it is difficult to maintain the state of indicating (or pointing at) the signal forwarding node by using the laser pointer, the exemplary embodiment of the present invention proposes that, once a selection is made, the selection is maintained for a predetermined period of time.

That is to say, when laser light is detected through the laser light receiver 402-2, the MCU 405 of the signal forwarding nodes 200-1 and 200-2 may be capable of receiving the IR control signal for a predetermined period of time stating from a time point when the laser has been detected, thereby being capable of forwarding the received IR control signal to the other signal forwarding node that is paired to the corresponding signal forwarding node.

Referring to FIG. 7B, the remote controller 203 is being manipulated while the third signal forwarding node 200-3 is being indicated by using the laser pointer of the remote controller 203. Accordingly, the third signal forwarding node 200-3 may be capable of receiving the IR control signal and converting the received IR control signal to a RF signal.

Meanwhile, the multiple signal forwarding nodes may be capable of sharing the power. This will be described in more detail with reference to FIG. 8.

Figure 8:
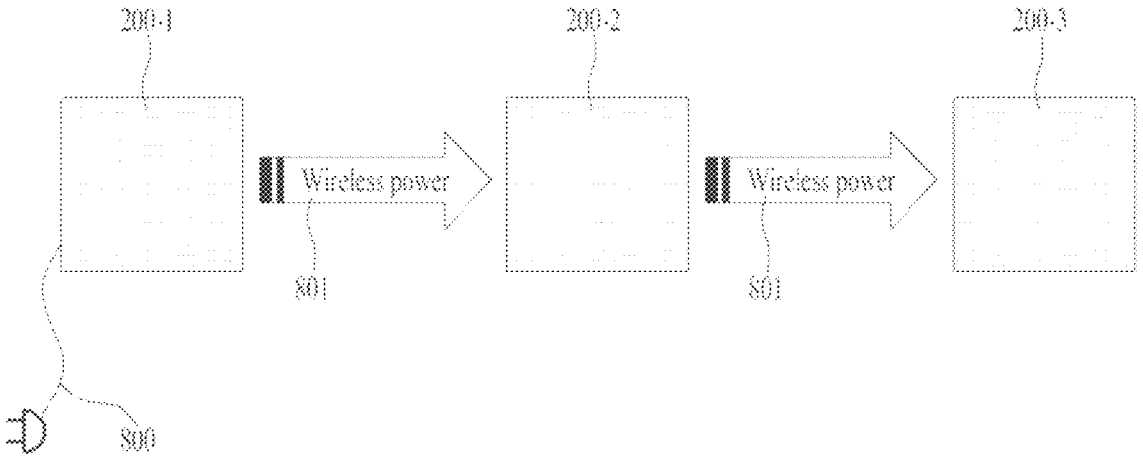
FIG. 8 illustrates a control method for wirelessly sharing power among the multiple signal forwarding nodes according to an exemplary embodiment of the present invention.

FIG. 8 illustrates a control method for wirelessly sharing power among the multiple signal forwarding nodes according to an exemplary embodiment of the present invention.

Referring to FIG. 8, the first to third signal forwarding nodes 200-1 to 200-3 are aligned one next to another (i.e., side-by-side), and only the first signal forwarding node 200-1 is supplied with power from an external power source 800.

The first signal forwarding node 200-1 may wirelessly supply power 801 to the second signal forwarding node 200-2. Similarly, the second signal forwarding node 200-2 may wirelessly supply power 801 to the third signal forwarding node 200-3. Since the method of wireless supplying power is apparent to anyone skilled in the art, detailed description of the same will be omitted for simplicity.

In the description provided up to this point, although the description is provided under the assumption that pairing is established between two signal forwarding nodes, the exemplary embodiment of the present invention may also be applied to a case when pairing is established among multiple signal forwarding nodes. This will hereinafter be described in more detail with reference to FIGS. 9A, 9B and 9C.

Figure 9A:
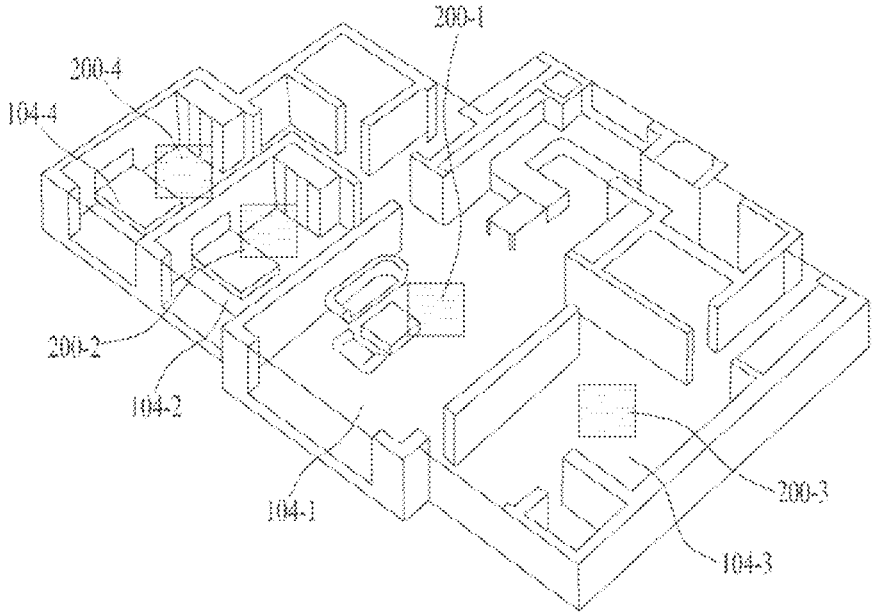
FIGS. 9A, 9B, and 9C illustrate a control method of a case when multiple signal forwarding nodes are paired according to an exemplary embodiment of the present invention.
Figure 9B:
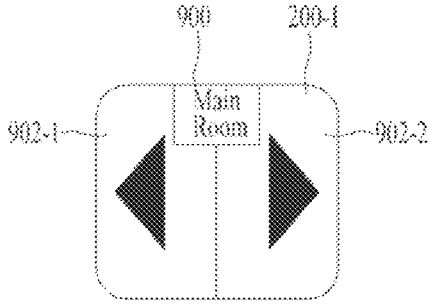
Figure 9C:
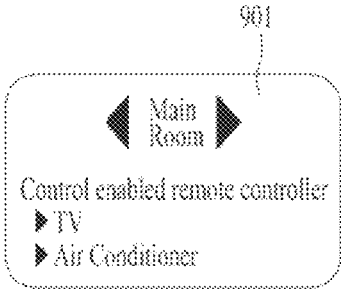

FIGS. 9A, 9B and 9C illustrate a control method of a case when multiple signal forwarding nodes are paired according to an exemplary embodiment of the present invention.

Referring to FIG. 9A, the first signal forwarding node 200-1 is positioned in the Living Room 104-1, and the second to fourth signal forwarding nodes 200-2 to 200-4 are respectively positioned in each of the first to third rooms (or Room 1 to Room 3) 104-2 to 104-4.

At this point, it will be assumed that the first to fourth signal forwarding nodes 200-1 to 200-4 are paired to one another.

FIG. 9B illustrates a front view of the first signal forwarding node 200-1. In FIG. 9(*b*), although only the first signal forwarding node 200-1 is illustrated, the remaining signal forwarding nodes shall also have the same structure.

Referring to FIG. 9B, the first signal forwarding node 200-1 may provide an indication 900 of the location to which the IR control signal is to be forwarded.

That is to say, in case the location is indicated as 'Main Room', the IR control signal may be forwarded to the electrical appliance positioned (or installed) in the Main Room.

Meanwhile, in the illustrated example, although the location is indicated as the 'Main Room' such indication may also be expressed as a change in color of the corresponding signal forwarding node. By expressing the indication using colors, even though the distance between the signal forwarding nodes is long, the room in which the control is intended to be performed may be easily identified.

Meanwhile, instead of indicating the location, the name of the electrical appliance that is intended to be controlled (or that is being controlled) may also be indicated.

FIG. 9C illustrates an output status diagram of a display unit 901 being equipped in the remote controller 203 according to the exemplary embodiment of the present invention.

In case the location to which the IR control signal is being forwarded is indicated as the 'Main Room', the remote controller 203 may output a list of electrical appliances positioned in the 'Main Room' through the display unit 901. When any one of the electrical appliances that are outputted to the display unit 901 is selected, control buttons corresponding to the selected electrical appliance may then be outputted.

Meanwhile, if the location that is being controlled is to be changed (or shifted) to another location, the user may shift the location by using Location Shift buttons (user input unit) 902-1 and 902-2.

That is to say, in case a first Location Shift button 902-1 is selected, the controlled location may be shifted from the 'Main Room' to a 'Small Room'.

As described above, in case multiple signal forwarding nodes are paired to one another all together, in order to maximize the functions of the signal forwarding nodes, each signal forwarding node may be provided with a transparent case.

This is because the signal forwarding node should be capable of receiving an IR control signal, which is received from the remote controller 203, from diverse locations, and also because the signal forwarding node should be capable of transmitting the IR control signal to diverse directions (or locations) in order to control the electrical appliances that are positioned in diverse locations.

Meanwhile, the exemplary embodiment of the present invention further proposes a feedback condition in order to determine whether or not the IR control signal, which is forwarded as described above, is operating properly.

For example, when the user has manipulated the remote controller so as to turn off the Air Conditioner, which is positioned in the room, while remaining in the Living Room, there exists a need for verifying whether or not the signal is properly forwarded (or delivered) to the Air Conditioner and whether or not the Air Conditioner is turned off accordingly.

Therefore, the exemplary embodiment of the present invention proposes to determine whether or not the electrical appliances are turned off, by using noise generated from the electrical appliances when the appliances are being operated as feedback. For this, the signal forwarding node may further include a microphone.

For example, when a specific ring tone, such as "Ding dang dong", which is emitted when the Air Conditioner is being turned off, is recognized, the signal forwarding nodes 200-1 and 200-2 may determine that the corresponding signal has been properly forwarded (or delivered).

Conversely, if the corresponding ring tone is not recognized, the signal forwarding nodes 200-1 and 200-2 continuously regenerate (or reproduce) the IR control signal and repeatedly perform transmission until the corresponding ring tone is recognized. If feedback is not recognized even after a predetermined number of repeated transmission, the signal forwarding node may output a warning sound indicating that the control has failed.

Figure 10:
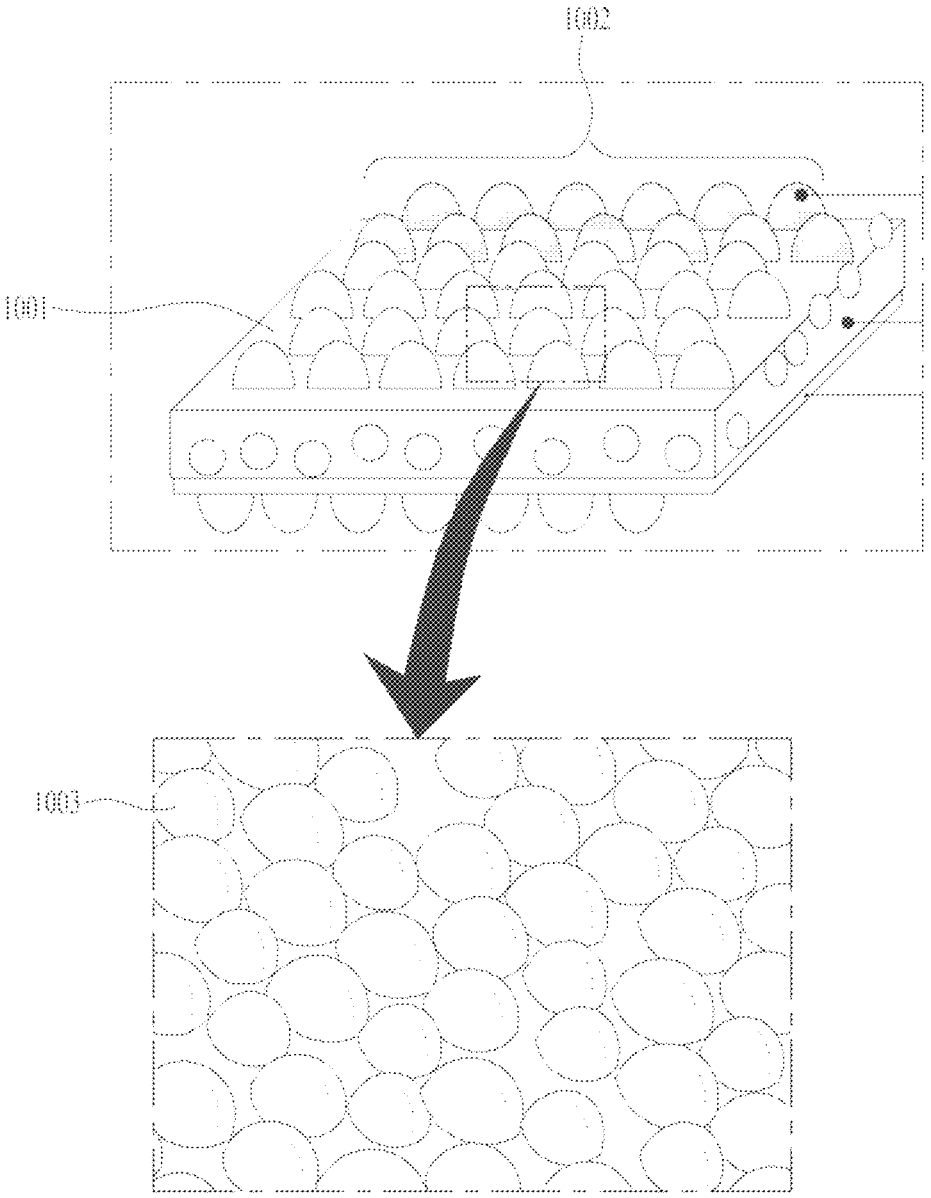
FIG. 10 illustrates a conceptual view showing a surface structure of a light diffusion sheet according to an exemplary embodiment of the present invention.

FIG. 10 illustrates a conceptual view showing a surface structure of a light diffusion sheet according to an exemplary embodiment of the present invention.

Convex protrusions 1002 are repeatedly formed on a surface of the light diffusion sheet 1001 (see enlarged screen of 1003). Such repeated forms (or convex protrusions) 1002 may each perform a function of a convex lens. Accordingly, each form 1002 may be capable of refracting light being irradiated upward (i.e., from bottom to top) to diverse directions.

If the light is refracted to diverse directions, eventually, the IR control signal that is reconfigured according to the exemplary embodiment of the present invention may also be forwarded (or delivered) in diverse directions.

Meanwhile, by using multiple light diffusion sheets at the same time, a larger range of diffusion may be realized. This will hereinafter be described in more detail with reference to FIG. 11.

Figure 11:
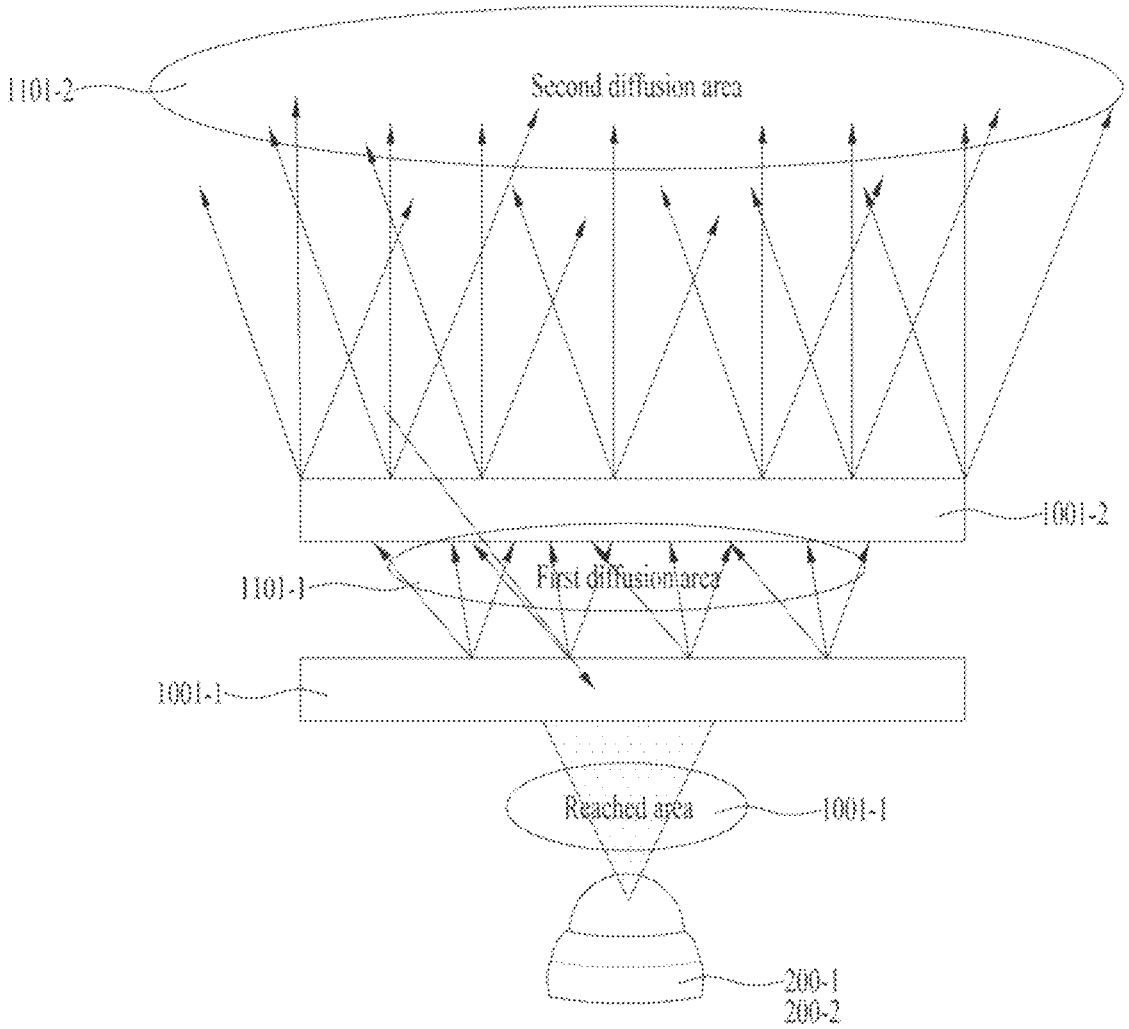
FIG. 11 illustrates a conceptual view showing a wider diffusion area by using multiple light diffusion sheets according to an exemplary embodiment of the present invention.

FIG. 11 illustrates a conceptual view showing a wider diffusion area by using multiple light diffusion sheets according to an exemplary embodiment of the present invention.

If the IR signal, which is reconfigured by the signal forwarding nodes 200-1 and 200-2, does not pass through the light diffusion sheet, the reconfigured IR signal may form a diffusion area equivalent to the reached area (or area of reach) 1001-1. If the reconfigured IR signals passes through the first light diffusion sheet 1001-1, the reconfigured IR signal may be diffused up to a first diffusion area 1101-1, which is slightly wider (or broader) than the reached area 1001-1.

In order to allow the reconfigure IR signal to be diffused up to a second diffusion area 1101-2, which is broader (or wider) than the first dispersion area 1101-1, this may be realized by having the reconfigured IR signal pass through a second light diffusion sheet 1001-2.

That is to say, as the IR signal passes through a larger number of light diffusion sheets, the intensity of the light may be decreased yet the area which the light reaches may become wider.

Furthermore, in order to verify the feedback condition, volume control (or volume adjustment) may be further performed.

For example, when it is assumed that a signal for turning off the power of the TV is transmitted, a control signal increasing or decreasing the TV volume may be further transmitted, and, in case the TV increases or decreases its volume in response to the corresponding control signal, it may be determined and recognized that the power of the TV is still on.

Accordingly, an IR signal for turning off the power of the TV may be reproduced (or regenerated) and then transmitted.

As described above, the method for forwarding a remote control signal and the signal forwarding node using the same according to the present invention have the following advantages. According to at least one of the exemplary embodiments of the present invention, the present invention is advantageous in that electrical appliances positioned in other rooms may be controlled by using an intuitive control method.

Furthermore, the above-described present invention may be implemented as a code in a storage medium having a computer-readable program recorded therein. The medium that can be read by a computer includes all types of recording devices having data, which can be read by a computer system, stored therein. Examples of the computer-readable storage medium may include a Hard Disk Drive (HDD), a Solid State Disk (SSD), a Silicon Disk Drive (SDD), a ROM, a RAM, a CD-ROM, an electro-magnetic tape, a floppy disk, an optical data storage device, and so on. Additionally, the computer-readable storage medium may also include storage media that can be realized in the form of carrier waves (e.g., transmission via the Internet). Furthermore, the computer may also include the controller 180 of the device. Accordingly, the detailed description of the present invention, which is presented above, shall not be restrictedly interpreted in any aspect and shall only be interpreted as an exemplary embodiment. The scope of the present invention shall be decided based upon reasonable interpretation of the appended claims, and all modifications and variations made within the equivalent scope of the present invention shall be included in the scope of the present invention.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A signal forwarding node, comprising:
- a laser light receiver;
- an Infra Red (IR) light receiver;
- a memory configured to store IR codes for controlling at least one external device;
- an IR emitter;
- a display;
- a user input unit;
- a wireless communication module; and
- a controller configured to:
  - detect laser light via the laser light receiver;
  - receive a remote control signal via the IR light receiver;
  - cause the wireless communication module to forward control information included in the received remote control signal to an external signal forwarding node when the laser light is detected and the remote control signal is received;
  - cause the IR emitter to transmit an IR code stored in the memory and corresponding to the received remote control signal to the external signal forwarding node when control information is received from the external signal forwarding node;
  - cause the display to display a first location at which a first electrical appliance to be controlled is positioned;
  - cause the display to display a list of electrical appliances positioned at the first location such that one electrical appliance is selected from the list of electrical appliances;
  - cause the display to display control buttons corresponding to the selected electrical appliance; and
  - change a control location from the first location to a second location at which a second electrical appliance to be controlled is positioned in response to selection of a location shift button via the user input unit, the location shift button selected while the first location is displayed.

2. The signal forwarding node of claim 1, wherein the controller is further configured to not forward the remote control signal to the external signal forwarding node when the remote control signal is not received within a predetermined period of time after the laser light is detected.

3. The signal forwarding node of claim 1, wherein the controller is further configured to not forward the remote control signal to the external signal forwarding node when the laser light is not detected even if the remote control signal is received.

4. The signal forwarding node of claim 1, wherein:
- the signal forwarding node is present in a first area;
- the external signal forwarding node and the at least one external device are present in a second area;

the signal forwarding node is directly reachable by the remote control signal while the external forwarding node and the at least one external device are not reachable by the remote control signal.

5. The signal forwarding node of claim 1, wherein the controller is further configured to cause the IR emitter to re-transmit the IR code when feedback corresponding to the IR code transmission is not received.

6. The signal forwarding node of claim 5, further comprising:

a microphone, wherein the feedback corresponds to predetermined audio data recognized via the microphone.

7. The signal forwarding node of claim 1, wherein the controller is further configured to automatically update the IR codes stored in the memory.

8. The signal forwarding node of claim 1, further comprising:

a dispersion lens configured to disperse an IR code being transmitted from the IR emitter in multiple directions.

9. A method for controlling signal forwarding at a signal forwarding node, the method comprising:

detecting laser light via a laser light receiver;

receiving a remote control signal via an Infra Red (IR) light receiver;

forwarding control information included in the received remote control signal to an external signal forwarding node via a wireless communication module when the laser light is detected and the remote control signal is received;

storing IR codes for controlling at least one external device in a memory;

causing an IR emitter to transmit an IR code stored in the memory and corresponding to the received remote control signal to the external signal forwarding node when control information is received from the external signal forwarding node;

displaying a first location at which a first electrical appliance to be controlled is positioned;

displaying a list of electrical appliances positioned at the first location such that one electrical appliance is selected from the list of electrical appliances;

displaying control buttons corresponding to the selected electrical appliance; and changing a control location from the first location to a second location at which a second electrical appliance to be controlled is positioned in response to selection of a location shift button via the user input unit, the location shift button selected while the first location is displayed.

10. The method of claim 9, wherein the remote control signal is not forwarded to the external signal forwarding node when the remote control signal is not received within a predetermined period of time after the laser light is detected.

11. The method of claim 9, wherein the remote control signal is not forwarded to the external signal forwarding node when the laser light is not detected even if the remote control signal is received.

12. The method of claim 9, wherein:

the signal forwarding node is present in a first area;

the external signal forwarding node and the at least one external device are present in a second area;

the signal forwarding node is directly reachable by the remote control signal while the external forwarding node and the at least one external device are not reachable by the remote control signal.

13. The method of claim 9, further comprising:

re-transmitting the IR code when feedback corresponding to the IR code transmission is not received.

14. The method of claim 13, further comprising:

recognizing predetermined audio data via a microphone, wherein the feedback corresponds to the recognized predetermined audio data.

15. The method of claim 9, further comprising:

automatically updating the IR codes being stored in the memory.

16. The method of claim 9, further comprising:

dispersing an IR code being transmitted from the IR emitter in multiple directions.

* * * * *